US009685040B2

(12) United States Patent
Meyer

(10) Patent No.: US 9,685,040 B2
(45) Date of Patent: Jun. 20, 2017

(54) ELECTRONIC SLOT MACHINE WITH OPTIONAL TRIGGERED GAMES

(71) Applicant: AINSWORTH GAME TECHNOLOGY LIMITED, Newington, NSW (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 253 days.

(21) Appl. No.: 13/793,400

(22) Filed: Mar. 11, 2013

(65) Prior Publication Data

US 2013/0310149 A1 Nov. 21, 2013

(30) Foreign Application Priority Data

May 16, 2012 (AU) ..... 2012902016

(51) Int. Cl.
*G07F 17/32* (2006.01)
*G07F 17/34* (2006.01)

(52) U.S. Cl.
CPC ..... *G07F 17/3267* (2013.01); *G07F 17/32* (2013.01); *G07F 17/3288* (2013.01); *G07F 17/34* (2013.01)

(58) Field of Classification Search
CPC ..... G07F 17/32; G07F 17/34
USPC ..... 463/21
See application file for complete search history.

(56) References Cited

U.S. PATENT DOCUMENTS

| | | | | |
|---|---|---|---|---|
| 8,038,524 | B2 | 10/2011 | Bryant et al. | |
| 8,465,357 | B2 | 6/2013 | Bryant et al. | |
| 8,475,256 | B2 | 7/2013 | Bryant et al. | |
| 2003/0064784 | A1* | 4/2003 | Wells et al. | 463/20 |
| 2003/0134673 | A1* | 7/2003 | Moody | G07F 17/3267 463/20 |
| 2003/0207707 | A1* | 11/2003 | Slomiany | G07F 17/3244 463/16 |
| 2005/0026672 | A1* | 2/2005 | Roukis | 463/16 |
| 2010/0048293 | A1* | 2/2010 | Hornik | 463/25 |
| 2012/0004024 | A1 | 1/2012 | Bryant et al. | |
| 2013/0079103 | A1* | 3/2013 | Nicely | G07F 17/3223 463/20 |
| 2013/0090154 | A1* | 4/2013 | Bryant et al. | 463/20 |
| 2014/0256404 | A1* | 9/2014 | Baerlocher et al. | 463/20 |

FOREIGN PATENT DOCUMENTS

| | | |
|---|---|---|
| AU | 2001100644 | 1/2002 |
| AU | 771847 | 10/2007 |
| AU | 2011200453 | 8/2012 |

* cited by examiner

*Primary Examiner* — Lawrence Galka
(74) *Attorney, Agent, or Firm* — Cook Alex Ltd.

(57) ABSTRACT

An electronic gaming machine includes a display and an electronic game controller. A first game, second game and third game are playable on the display, the second game being triggered during play of the first game and the third game being triggered during play of the second game. A player must make an additional wager to play one of the second and third games and does not need to make a further bet to play the other of the second and third games. A gaming method is also provided.

30 Claims, 5 Drawing Sheets

ELECTRONIC SLOT MACHINE WITH OPTIONAL TRIGGERED GAMES

BACKGROUND

The present invention relates to an electronic gaming machine and in a particular an electronic gaming machine using a primary game and a second bonus game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

A primary type of electronic gaming machine offers a main or base game having multiple sets of reels to permit a player to play several reels at the same time, depending on the amount that is wagered or bet by the player. For example, a gaming machine could offer four reel sets each having 50 pay lines available for selection by the player. By wagering a suitable amount, such as 200 credits, the player can play all 50 pay lines and thus all four reel sets. An electronic gaming machine may also offer an ante-bet feature, where the player makes further bet(s) each game that permits access to certain additional feature games or enhancements in the base game that otherwise be unobtainable. For example, a player could bet an extra 50 credits in addition to an initial bet of 100 credits that trigger an extra 10 free games when the free game feature is triggered that would not ordinarily be awarded without that extra ante-bet. In another example, a bet of an extra 100 credits adds further wild symbols to the base game and/or feature game reels that would not ordinarily be awarded without that extra ante-bet. In a further example, a bet of an extra 150 credits buys an additional reel in the base game that multiplies prizes for winning combinations, the extra reel not ordinarily being awarded without that extra ante-bet.

Traditionally, it is commonplace for bonus or "feature" games being provided by an electronic gaming machine in addition to the base or main game, whereby the feature game is activated by a trigger event during play of the base game and offered free to the player. Therefore, once a feature game is triggered, there is no amount that needs to be wagered for the player to play the feature games. In other words, while some feature games require an extra or ante-bet to qualify for additional features, traditionally the feature games are played without the player having to make an extra or side bet in addition to the original amount bet to play the base game. Once the free feature games have been played, the electronic gaming machine resets itself and returns the player back to the base game. This standard structure to game play limits the variation in the play of the electronic gaming machine. Consequently, it is difficult to retain player interest because there is no apparent incentive for the player to continue playing the same electronic gaming machine once the player becomes familiar with the feature game and the main game.

It is an object of the present invention to overcome or substantially ameliorate one or more of the disadvantages of prior art, or at least to provide a useful alternative.

It is an object of the invention in at least one preferred form to provide an electronic gaming machine and a method for controlling an electronic gaming machine that encourages player interest.

SUMMARY

According to a first aspect of the invention, there is provided an electronic gaming machine comprising:

a display for displaying game symbols for playing a first game, wherein a player must make an initial bet to play said first game and wherein predetermined winning combinations of randomly selected game symbols in said first game results in the award of prizes to a player, and an electronic game controller for controlling the display of game symbols on the display, wherein, in response to a first trigger event during play of said first game, said electronic game controller causes said display to display game symbols for playing a second game, wherein predetermined winning combinations of randomly selected game symbols in said second game results in the award of prizes to said player and/or one or more game enhancing elements that are applied in said second game, and wherein, in response to a second trigger event during play of said second game, said electronic game controller causes said display to display game symbols for playing a third game, wherein predetermined winning combinations of randomly selected game symbols in said third game results in the award of prizes to said player and/or one or more game enhancing elements that are applied in said third game, and wherein said player must wager an amount to play one or more games of one of said second and third games and wherein said player can play the other of said second and third games without making a bet.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Preferably, said player must wager an amount to play one or more games of said second game. In this case, the player can play said third game without making a bet. In one preferred form, said player must wager an amount to play each game of said one or more games of said second game.

Alternatively, said player must wager an amount to play one or more games of said third game. In this case, the player can play said second game without making a bet. In one preferred form, said player must wager an amount to play each game of said one or more games of said third game.

Preferably, the parameters for said wagered amount are the same as the parameters of said initial bet.

Preferably, the amount of the additional wager determines the number of games of said one of said second game and said third game that said player can play.

Preferably, said second game comprises an enhanced version of said first game. More preferably, said third game comprises an enhanced version of said second game. Alternatively, said third game comprises an enhanced version of said first game. In a further alternative, said first game, said second game and said third game are different to each other.

Preferably, said first trigger event comprises the appearance of at least one trigger symbol during play of said first game. Alternatively, said first trigger event comprises a random event determined by said electronic game controller during play of said first game.

Preferably, said second trigger event comprises the appearance of at least one trigger symbol during play of said second game. Alternatively, said second trigger event comprises a random event determined by said electronic game controller during play of said second game.

Preferably, said first trigger event causes a plurality of second games to be available for play by said player. In one preferred form, a fixed number of second games are available for play by said player. In another preferred form, said second games are available for play by said player until the occurrence of a first termination event during play of any one of said second games.

Preferably, said second trigger event causes a plurality of third games to be available for play by said player. In one preferred form, a fixed number of third games are available for play by said player. In another preferred form, said third games are available for play by said player until the occurrence of a second termination event during play of any one of said third games.

Preferably, where said player makes said wagered amount to play one or more of said second games and one of the game enhancing elements is awarded during play of or forms part of said one or more of said second games, said game enhancing element is also applicable from the beginning of play of said third game. In one preferred form, said game enhancing element comprises one or more win multipliers.

Preferably, any game enhancing elements that are awarded during play of said second games are also applicable from the beginning of play of said third games. For example, where more than one win multiplier is accumulated during play of said second games, any subsequently triggered third games also have a resultant win multiplier (i.e. the sum of the accumulated win multipliers) at the time said third games are triggered.

Preferably, the same game symbols are used in said first game, said second game and said third game. Alternatively, different game symbols or a mixture of the same and different game symbols are used in said first game, said second game and said third game.

Preferably, said first game has the same number of game symbols as said second game and/or said third game. In another preferred form, said first game, said second game and said third game have different numbers of game symbols.

Preferably, the game symbols in said first game, said second game and said third game are organised or arranged in the same way. In another preferred form, the game symbols in said first game, said second game and said third game are organised or arranged differently to each other.

Preferably, the game enhancing elements comprise at least one or more of bonus prizes, collector symbols, a win multiplier, wild multipliers, bonus wilds, held columns, bonus reels, changed reel strips, changed pay conditions, changed pay combinations, changed pay values, additional or new arrays of reels, additional or new pay lines, random wild symbols, progressives, bonus credits, jackpot symbols, and one or more symbol replacements.

Preferably, said game symbols in said first game, said second game and said third game are arranged in arrays. More preferably, said game symbols in said first game, said second game and said third game are arranged in differently shaped arrays. The shapes of said arrays are preferably rectangular, circular, triangular, oval, semi-circular or other non-rectangular shape. In one preferred form, the game symbols in said first game are arranged in a rectangular array, whereas the game symbols in said second game and/or said third game are non-rectangular in shape. This facilitates the player making a distinction between said first game and said second game and said third game.

Preferably, said electronic game controller causes display of said first game, said second game and/or said third game during play of said first game, said second game and said third game being inactive until triggered. In this preferred form, the change in said second game and said third game from being inactive to active may be indicated on the display. Alternatively, said electronic game controller causes the display of said second game in response to said first trigger event. Likewise, said electronic game controller causes the display of said third game in response to said second trigger event.

Preferably, said electronic game controller causes the display of said second game and/or said third game on a separate display to said display. Alternatively, said electronic game controller causes the display of said second game and/or third game on the same display.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

According to a second aspect of the invention, there is provided a gaming method for an electronic gaming machine comprising a display and an electronic game controller, the method comprising the steps of:

controllably displaying game symbols for playing a first game, wherein a player must make an initial bet to play said first game and wherein predetermined winning combinations of randomly selected game symbols in said first game results in the award of prizes to a player, and in response to a first trigger event during play of said first game, displaying game symbols for playing a second game, wherein predetermined winning combinations of randomly selected game symbols in said second game results in the award of prizes to said player and/or one or more game enhancing elements that are applied in said second game, and in response to a second trigger event during play of any one of said second games, displaying game symbols for playing a third game, wherein predetermined winning combinations of randomly selected game symbols in said third game results in the award of prizes to said player and/or one or more game enhancing elements that are applied in said third game, wherein said method further comprises the steps of said player wagering an amount to play one or more games of one of said second and third games and said player playing the other of said second and third games without making a bet.

Preferably, said wagering step comprises said player must wager an amount to play one or more games of said second game. More preferably, said wagering step comprises said player must wager an amount to play each game of said one or more games of said second game. In one preferred form, said method further comprises awarding one of said game enhancing elements during play of or forms part of said one or more of said second games and applying said game enhancing element from the beginning of play of said third game. In a particularly preferred form, said game enhancing element comprises one or more win multipliers.

Preferably, said wagering step comprises said player must wager an amount to play one or more games of said third game. More preferably, said player must wager an amount to play each game of said one or more games of said third game.

Preferably, said method further comprises making the parameters for said wagered amount the same as the parameters of said initial bet.

Preferably, said method further comprises determining the number of games of said one of said second game and said third game that said player can play based on the amount of the additional wager.

Preferably, said method further comprises randomly determining said first trigger event during play of said first game. Alternatively, said method further comprises randomly determining said second trigger event during play of said second game.

Preferably, said method further comprises applying any game enhancing elements that are awarded during play of said second games from the beginning of play of said third games.

Preferably, said method further comprises arranging said game symbols in said first game, said second game and said third game in differently shaped arrays.

Preferably, said method further comprises causing the display of said first game, said second game and/or said third game during play of said first game, wherein said second game and said third game are inactive until triggered. In this preferred form, the change in said second game and/or said third game from being inactive to being active may be indicated on the display. Alternatively, said method further comprises causing the display of said second game in response to said first trigger event. Likewise, said method further comprises causing the display of said third game in response to said second trigger event.

Preferably, said method further comprises displaying said second game and/or said third game on a separate display to said display. Alternatively, said method further comprises displaying second game and/or said third game with said first game on the same display.

The method also preferably has the preferred features of the first aspect of the invention not otherwise stated above, where applicable.

According to a third aspect of the invention, there is provided a computer system comprising a central processing unit configured for communication with an electronic gaming machine, wherein said computer system is configured to perform the method of the second aspect of the invention.

According to a fourth aspect of the invention, there is provided a computer program configured to perform the method of the second aspect of the invention.

According to a fifth aspect of the invention, there is provided a non-transitive carrier medium carrying computer executable code that, when executed on a central processing unit configured for communication with an electronic gaming machine, causes the central processing unit to perform the method of the second aspect of the invention.

BRIEF DESCRIPTION OF THE DRAWINGS

Preferred embodiments of the invention will now be described, by way of example only, with reference to the accompanying drawings in which.

DETAILED DESCRIPTION OF THE VARIOUS EMBODIMENTS

Figure 1:
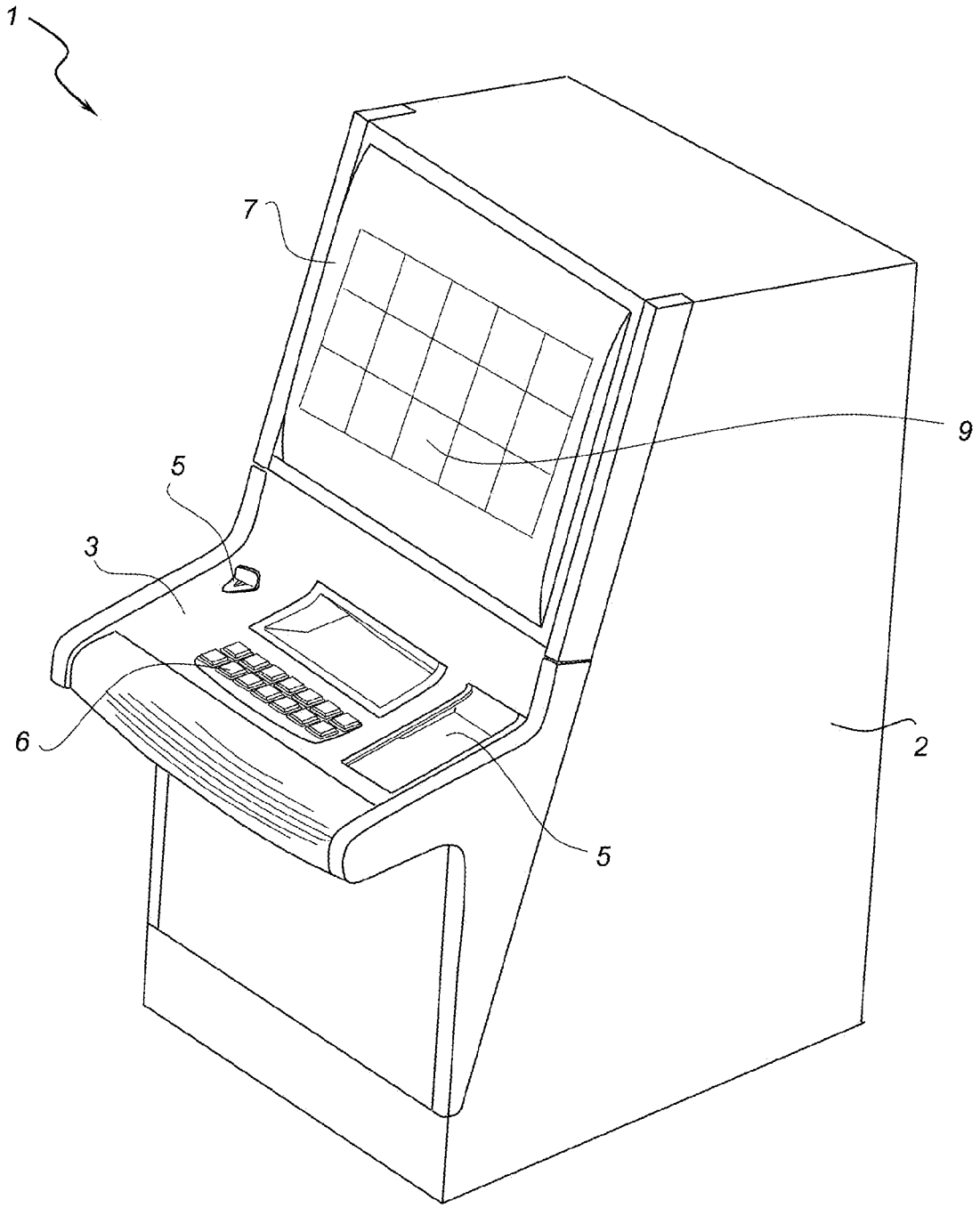
FIG. 1 is a perspective view of an electronic gaming machine according to a first embodiment of the invention.
Figure 2:
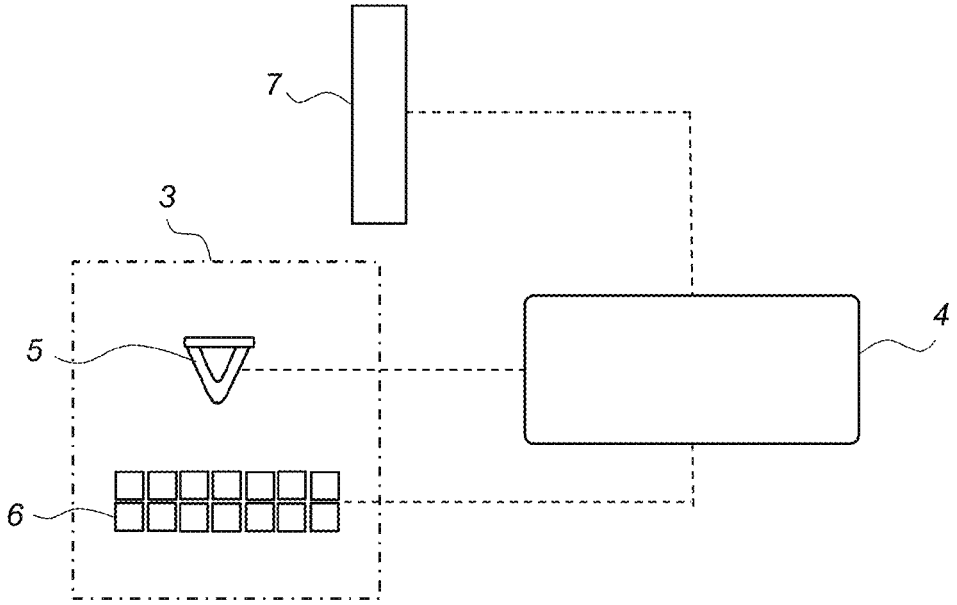
FIG. 2 is a schematic drawing of an electronic game controller for the electronic gaming machine of FIG. 1.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. The electronic game controller 4 is generally in the form of a central processing unit, such as a computer, and is in electronic communication a display 7 and various input devices on the console 3, as best shown in FIG. 2. It is also appreciated that a person skilled in the art would readily understand the location and use of the electronic game controller 4 in the electronic gaming machine 1.

Figure 3:
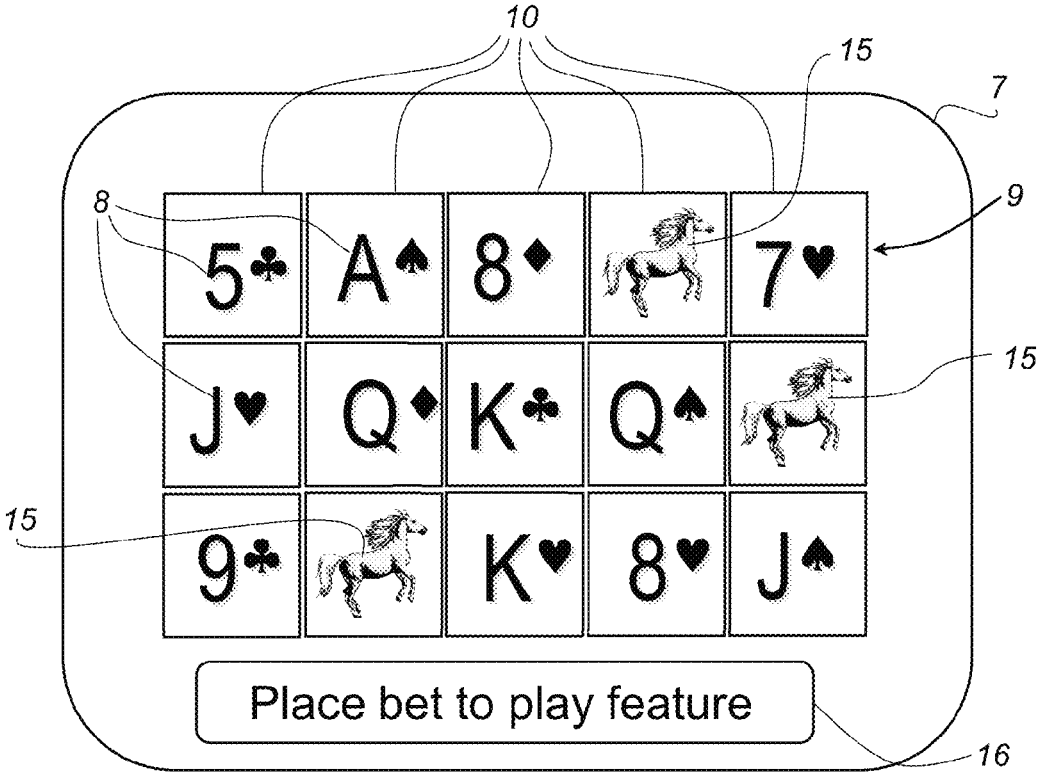
FIG. 3 is a schematic drawing illustrating a base game displayed on an array of the electronic gaming machine of FIG. 1, and FIGS. 4 to 6 are schematic drawings illustrating feature games played on the electronic gaming machine of FIG. 1.

The display 7 is used to display game symbols 8 for playing a first game in the form of a base or main game 9 on the electronic gaming machine 1, as best shown in FIG. 3. A player inserts a monetary amount into the electronic gaming machine 1 and selects an initial bet to initiate play of the base game 9. In the base game 9, the game symbols 8 are arranged in the form of three rows and five columns or "reels" 10. The game symbols 8 typically include picture symbols, wild symbols, scatter symbols and card symbols. Predetermined winning combinations of randomly selected game symbols 8 in the base game 9 result in the award of prizes to the player. These predetermined combinations are typically in the form of pay lines that have at least one game symbol 8 from each reel 10.

Figure 4:
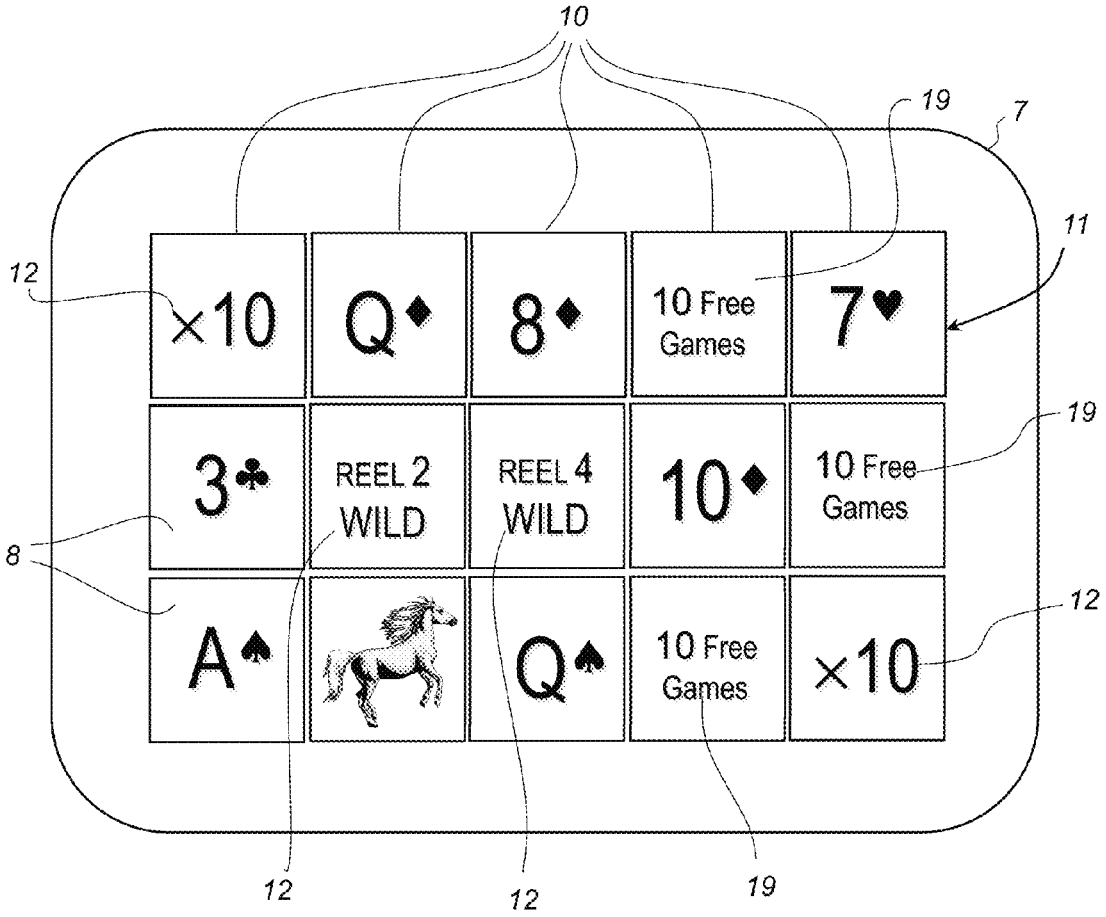

The electronic game controller 4 controls the display of the game symbols 8 in the base game 9. In response to a first trigger event during play of the base game 9, the electronic game controller 4 causes a second game in the form of a feature game 11 to appear on the display 7 for play by the player, as best shown in FIG. 4 where corresponding features have been given the same reference numerals. In this embodiment the feature game 11 comprises game symbols 8 are arranged in the form of three rows and five reels 10. The game symbols 8 typically include picture symbols, wild symbols, scatter symbols and card symbols.

In the feature game 11, predetermined winning combinations of randomly selected game symbols 8 result in the award of prizes to the player and/or game enhancing elements that are applied in the feature game. In this embodiment, the predetermined winning combinations of game symbols 8 can award the same prizes available in the base game and additional game enhancing elements in the form of symbols 12 that modify the outcome of the games played in the feature game 11.

Figure 5:
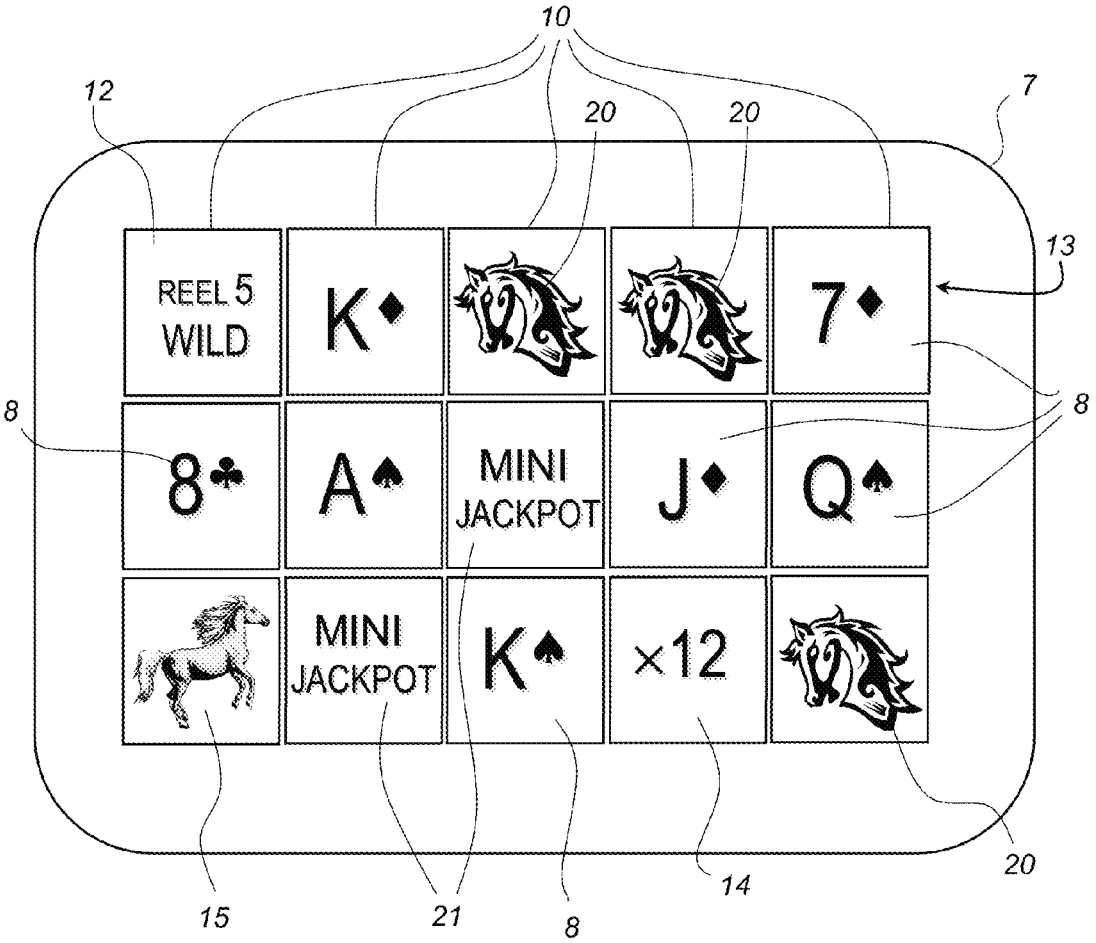

Similarly, the electronic game controller 4 also controls the display of the game symbols 8 in the feature game 11. In response to a second trigger event during play of the feature game 11, the electronic game controller 4 causes a third game in the form of another feature game 13 to appear on the display 7 for play by the player, as best shown in FIG. 5 where corresponding features have been given the same reference numerals. In this embodiment the feature game 13 comprises randomly selected game symbols 8 are arranged in the form of three rows and five reels 10. Again, the game symbols 8 typically include picture symbols, wild symbols, scatter symbols and card symbols.

In this additional feature game 13, predetermined winning combinations of randomly selected game symbols 8 also result in the award of prizes to the player and/or game enhancing elements 14 that are applied in the feature game. In the feature game 13, the predetermined winning combinations of game symbols 8 can award the same prizes available in the base game and feature game 11. Also, the predetermined winning combinations of game symbols 8 can award the game enhancing elements available in the feature game 11 as well as additional game enhancing elements 14. In this embodiment, the game enhancing elements 14 are generally enhanced versions of the game enhancing elements 12 in the feature game 11.

Operation of this embodiment of the invention will now be described in more detail with reference FIGS. 1 to 5. The player initially makes a bet using vending slots initiate play of the base game 9 and the electronic game controller 4 causes the reels 10 to appear to visibly rotate or "spin", and randomly display the game symbols 8. The initial bet involves the player selecting the number of pay lines that are to be played. For example, the player can bet or wager 50 credits to play 10 pay lines or 200 credits to play the maximum number of 50 pay lines. Also, the player can make any additional side bets or ante-bets to access additional features in the base game, such as increasing the number of winning combinations in the base game.

After the reels 10 stop spinning, the controller 4 determines whether there are any predetermined winning combinations of the game symbols 8 appearing in any player-selected pay lines, such as a two of a kind, three of a kind, four of a kind or five of a kind. It will be appreciated that other winning combinations of game symbols 8 can also be provided. If there is a predetermined winning combination present in the base game 9, the electronic gaming machine 1 enters a winning game state and awards a prize according to the displayed predetermined winning combination.

Where a predetermined trigger event occurs during play of the base game 9, which in this embodiment is the appearance of three scatter symbols in the form of a horse symbols 15, the electronic game controller 4 causes the display of the feature game 11 on the display 7. The electronic game controller 4 randomly determines whether the trigger event has occurred during play of the base game 9. The feature game 11 not only has the same game symbols 8 as the base game, but also includes game enhancing symbols 12. As best shown in FIG. 4, the game enhancing symbols 14 include a "×10" win multiplier, which multiplies by 10 the value of any predetermined combination of game symbols 8, and held reels, which causes the nominated reel to be "held" to display only wild symbols.

In this embodiment, the player is prompted to wager another amount or bet to enable play of the feature game 11, typically by an in-game message 16. As the feature game 11 has the same arrangement of three rows and five reels 10, the same bet parameters are used as the parameters for the base game 9. Following the player making the wagered amount, a predetermined number of the feature games 11 are available to the player. In one variation, the player plays a fixed number of feature games 11, such as ten games. In another variation, the number of feature games 11 available to the player depends on the amount of the additional wager. For example, an additional wager or bet of 50 credits would provide 5 spins of the feature game 11, an additional wager of 100 credits would provide 10 spins of the feature game and an additional wager of 150 credits would provide 15 spins of the feature game.

If the player elects not to make an additional wager, then the feature game 11 ceases and the electronic game controller 4 returns the electronic gaming machine 1 to the base game 9.

In the feature game 11, a predetermined number of the game enhancing symbols 12 must appear at the conclusion of a spin of the reels 10 before the game enhancing element is awarded to the player. For example, three ×10 win multiplier symbols must appear before it can be applied to any predetermined combination that is present at the conclusion of the spin of the reels 10. Similar conditions also apply to the other game enhancing symbols 12. The feature game 11 also pays winnings in the form of credits to the player for predetermined combinations of the game symbols 8 that appear in the reels 10. These winnings can be the same as or greater than the winnings that are paid for the same predetermined combinations of the game symbols 8 in the base game 9.

Where a game enhancing element is awarded to the player upon the appearance of the predetermined number of game enhancing symbols 12, that game enhancing element is applied to the outcome of that spin of the feature game 11 and any subsequent spins of the feature game. Thus, a player is able to accumulate game enhancing elements over play of the feature game 11, thereby increasing the chances of winning predetermined combinations of the game symbols 8. In effect, the feature game 11 is an enhanced version of the base game 9.

The game enhancing symbols 12 also include a "10 Free Games" symbol 19, which acts as a trigger symbol for triggering the second feature game 13. In this embodiment, the appearance of three "10 Free Games" symbols 19 is a trigger event that causes the electronic game controller 4 to display the feature game 13 on the display 7, as best shown in FIG. 5. However, other trigger symbols are also able to trigger the second feature game 13, and include "8 Free Games" and "15 Free Games" symbols. Depending on the type of trigger symbol that activates the second feature game 13, the player is granted 8, 10 or 15 free spins of the reels 10 in the feature game 13.

Generally, the second feature game 13 plays substantially the same as the first feature game 11. For example, the additional feature game 13 has the same game symbols 8 as the base game 9, and game enhancing symbols 12 used in the feature game 11. Also, as discussed above, the player is awarded game enhancing elements based on a predetermined number of game enhancing symbols 12 that appear at the conclusion of a spin of the reels 10. The game enhancing elements are also applied to the outcome of the spin of the feature game 13 and any subsequent spins of the second feature game. Thus, the second feature game 13 is essentially an enhanced version of the first feature game 11.

However, unlike the first feature game 11, the second feature game 13 is available for play by the player without having to make an additional wager. Also, the game enhancing elements that have been awarded to the player in the first feature game continue to apply to the second feature game 13. For example, a ×10 win multiplier that is received during play of the first feature game will apply to all wins in subsequent spins in the first feature game 11 and all the spins in the second feature game 13. Thus, the player has even greater chances of winning predetermined combinations of the game symbols 8 compared to both the base game 9 and the first feature game 11.

Furthermore, there are additional game enhancing symbols unique to the feature game 13, such as collector symbols in the form of horse head symbol 20 and "MINI" jackpot symbols 21. The accumulation of the collector symbols 20 and 21 during the free spins of the second feature game 13 game leads to the trigger of additional prizes or game enhancing symbols, depending on the number of collector symbols that are collected. These additional prizes include stand alone and are typically in the form of progressive prizes like a progressive mini, major or grant jackpot.

Once all the free spins have been played in the second feature game 13, the electronic game controller 4 returns the electronic gaming machine 1 to the first feature game 11 where there are remaining spins to be played on the first feature game. Where there are no further spins available in the first feature game 11, the electronic game controller 4 returns the electronic gaming machine 1 to the base game 9.

By allowing the player to access a cascading set of feature games with game modifying game enhancing elements, and associating at least one set of feature games with an additional wager, player excitement and anticipation is enhanced as the player needs to weigh the risks in making the additional wager to access the feature game against the advantages of obtaining enhanced games and a free feature game. This added complexity and unpredictable variety in game play increases the likelihood that a player will prefer to continue playing the same electronic gaming machine. This player excitement and anticipation is further enhanced in the preferred embodiment by the prospects of accumulating game enhancing elements across both sets of feature games.

In one preferred form of the invention, the manner of access to the feature games is reversed. That is, the first feature game 11 is offered free to the player and second feature game 13 requires the player to make an additional wager to access the second feature game. As a consequence, the in-game message 16 would only appear with the second feature game 13 on the screen 7 and not with the first feature game 11. Aside from this primary difference, the first feature game 11 and second feature game 13 would operate as previously described.

In another preferred form of the invention, there is no fixed or predetermined number of games or spins in the first feature game 11 and/or the second feature game 13. Instead, the player continues to play the first feature game 11 and/or the second feature game 13 until a separate termination event occurs to conclude the respective games. For example, a predetermined number of "BOMB" symbols appearing at the end of a spin of the reels 10 in the first feature game 11 causes the electronic game controller 4 to return the electronic gaming machine 1 to the base game 9. Similarly, a predetermined number of "BOMB" symbols appearing at the end of a spin of the reels 10 in the second feature game 13 causes the electronic game controller 4 to return the electronic gaming machine 1 to the first feature game 11 if there were any remaining spins to be played when the second feature game 13 was triggered.

While the same game format is essentially used across the base game 9, first feature game 11 and second feature game 13, it will be appreciated that the games may vary across all three games. For example, the base game 9 may be a standard five reel game, the first feature game a card-type game and the second feature game may be a wheel-type game, where the pointer awards the game enhancing element. Similarly, the base game 9, first feature game 11 and second feature game 13 may each have different game symbols, game rules and pay tables that are unique to each game.

The grand progressive jackpot is typically confined to the electronic gaming machine 1. However, in another preferred form, the grand progressive jackpot is configured to be part of a wide area or in-house link progressive jackpot. In other words, the grand progressive jackpot can be awarded on a group of networked gaming machines in a specified area or a group of specified electronic gaming machines that are linked together for jackpot purposes.

Although the preferred embodiments of the invention have been described as awarding a specific number and types of game enhancing elements, it will be appreciated that the feature games 11 and 13 can be configured to award any number or types of game enhancing elements. In addition, the paid feature game 11 may provide game enhancing symbols 12 of greater value and/or frequency compared to the free feature game 13. Alternatively, the second feature game 13 provides game enhancing symbols 12 of greater value and/or frequency compared to the first feature game 11.

The game enhancing elements could also be changes to the operation of the feature game 11 without requiring any symbols to appear on the reels 10 to cause the change in operation of the feature game. For example, it is possible for all wins in the feature game 11 to be multiplied by a fixed number (i.e. ×2, ×3, etc) without requiring a specific game symbol to appear in the reels 10 on the display 7.

In such a case, the trigger event is a predetermined number or range of numbers and the electronic game controller 4 internally generates a random number and checks if it is the predetermined number or within the range. For example, the trigger event could be a number between 1 and 10 and the electronic game controller 4 internally generates a random number between 1 and 100. If the generated number is any one of numbers 1 to 10, then this triggers the win multiplier to take effect in the feature game 11. The award of the game enhancing element is indicated to the player by a suitable message, animation and/or sound effects.

Other game enhancing elements can include one or more of bonus prizes, collector symbols, a win multiplier, wild multipliers, bonus wilds, held columns, random wild symbols, changed reel strips, changed pay conditions, changed pay combinations, changed pay values, additional or new reels, additional or new arrays of reels, additional or new pay lines, progressives, bonus credits, jackpot symbols, and one or more symbol replacements.

Held columns or reels typically involve the column or reel to only display wild card symbols, thus enhancing the probability of achieving a predetermined combination. Jackpot symbols typically award a jackpot prize after accumulating a predetermined number of jackpot symbols over a number of games that are played. Progressives operate in a similar manner to jackpot symbols in that a prize is awarded upon a certain number of progressive symbols are accumulated by the player over a number of games played on the gaming machine.

Figure 6:
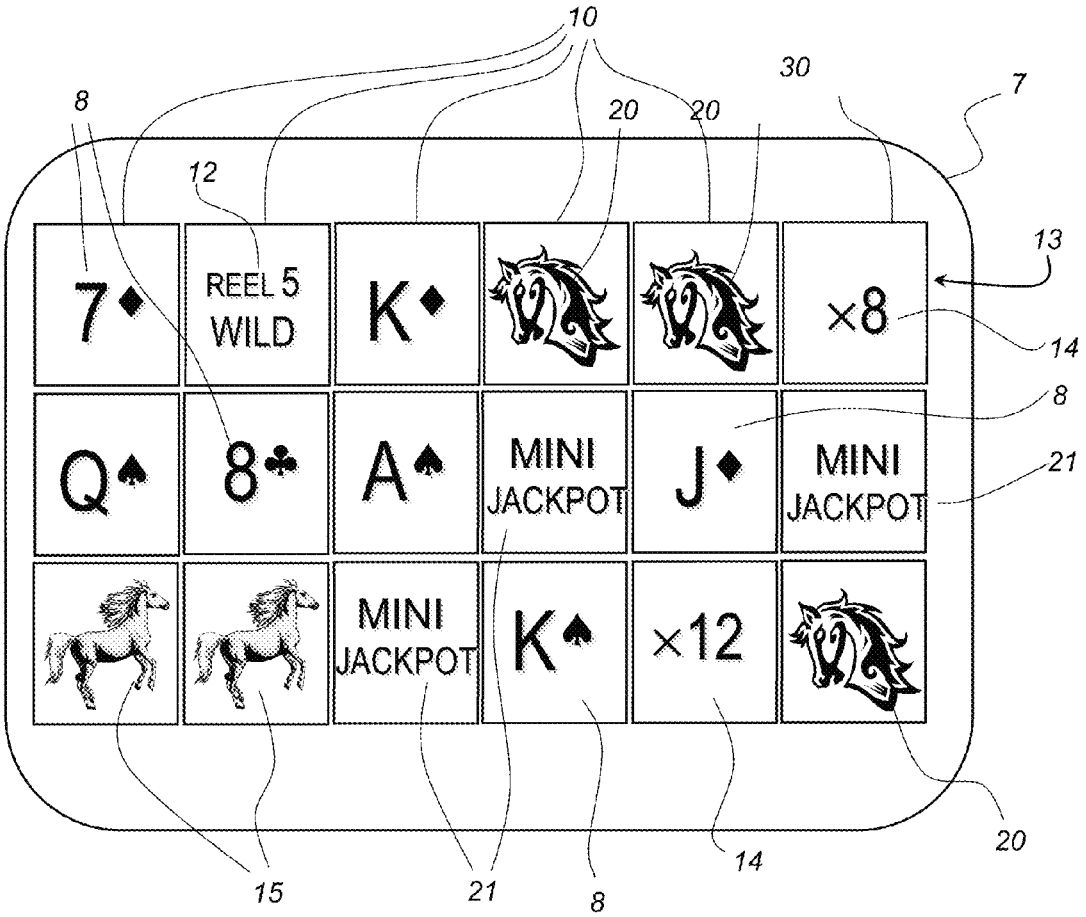

Also, the game enhancing element may add one or more extra reels to the feature game 11, 13. For example, a sixth reel 30 can be added to the feature game 13 when a certain game enhancing symbol appears in the reels 10, a predetermined number of specific symbols are accumulated by the player during play of the feature game 13 or internally triggered as described in the paragraphs above, as best shown in FIG. 6. The sixth reel 30 can also display standard game symbols (like picture card symbols, wild symbols and scatter symbols) and/or game enhancing symbols combination of a sixth reel with 3 multipliers that add together increases player interest and excitement. Thus, it is not just the original game array symbols that can be enhanced or changed, but the game enhancements can include any changes to the game rules that improve the player's chances of winning. These extra or bonus reels can either connect to the array of reels in the feature game 11, 13 or be displayed as a separate set or array of reels.

In other preferred forms of the invention, the trigger event is the appearance of a predetermined number of trigger symbols randomly appearing on any of the reels 10 in the base game 9, feature game 11 and feature game 13, a predetermined combination of symbols or any other predefined event during game play.

While the embodiment of the invention has been described in relation to two feature games, it will be appreciated that the invention could include further feature games that build upon the above-described feature games to further enhance the cascading feature game aspect of the invention.

In another preferred form, the game enhancing symbols 12 may indicate the duration in which its game enhancing element is applied, such as a predetermined number of spins or a predetermined time period.

Also, in a further preferred form, the player can selectively stop spinning of the reels 10 in the feature game 11 and feature game 13 to increase player interaction and provide the player with an opportunity to guess when a desired game enhancing symbol 12 may appear. Furthermore, the player can start spinning of the reels 10 in the feature game 11 and feature game 13 to further enhance player interaction.

In other preferred forms, the base game 9, first feature game 11 and second feature game 13 are displayed on separate screens, rather than being sequentially replaced on a single screen 7. Alternatively, the base game 9, first feature game 11 and second feature game 13 are displayed together on the screen 7, with suitable animation or highlighting being used to indicate that the first feature game 11 and/or second feature game 13 become active.

In another preferred form, the video screen 7 is a touch screen for use in addition to the player-actuatable buttons 6 so as to enable the player to select various features, such as making monetary bets for the game and responding to any messages or requests issued on the electronic gaming machine 1 by the electronic game controller 4. In this case, the player may control when the reels 10 start spinning and stop spinning in any of the base game 9, feature game 11 and feature game 13 by simply touching the relevant reel 10.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer program configured to perform the invention. In this way the invention can be implemented in various ways on an electronic gaming machine. In a further aspect, the invention includes a computer system configured comprising a central processing unit configured for communication with an electronic gaming machine to perform the invention. In a yet another aspect, the invention includes a non-transitive carrier medium carrying computer executable code that, when executed on a central processing unit configured for communication with an electronic gaming machine, causes said central processing unit to perform the invention. In this case, the non-transitive carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, providing game enhancing elements of limited duration can be combined with using different types of games in the base game 9, first feature game 11 and second feature game 13.

By providing a set of feature games including game enhancing elements with an additional wager option for one of the feature games, the player's anticipation and excitement is heightened as the player is stimulated by risk/reward decision making in weighing the additional wager against the potential benefits in accessing the feature game, including another free feature game. The player's excitement and anticipation is also heightened in the preferred embodiment by the accumulation of game enhancing elements across both feature games. Also, combination of paid and free feature games provides more variety, and thus generates more player interest. The invention also adds greater value to a player in terms of the probability of winning a prize relative to the amount bet or wagered, especially compared to a conventional electronic gaming machine that only has one set of reels and a single feature game. All these advantages of the invention result in the player being more likely to retain interest in continuing to play the same electronic gaming machine due to the variation in game play on the gaming machine. Furthermore, since the electronic game controller controls operation of the base game, first feature game and second feature game, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a display for displaying game symbols for playing a first game, wherein a player must make an initial bet to play said first game and wherein predetermined winning combinations of randomly selected game symbols in said first game results in the award of prizes to a player, vending slots for receiving monetary bets, an electronic game controller being adapted to determine if the initial bet has been made using the vending slots to initiate play of said first game and to control the display of game symbols on the display if the initial bet has been received, wherein, in response to a first trigger event during play of said first game, said electronic game controller causes said display to display game symbols for playing a second game, wherein predetermined winning combinations of randomly selected game symbols in said second game results in the award of prizes to said player and/or one or more game enhancing elements that are applied in said second game, wherein, in response to a second trigger event during play of said second game, said electronic game controller causes said display to display game symbols for playing a third game, wherein predetermined winning combinations of randomly selected game symbols in said third game results in the award of prizes to said player and/or one or more game enhancing elements that are applied in said third game, wherein said player must wager an amount to play one or more games of one of said second and third games when said first trigger event or second trigger event occurs and said player can play the other of said second and third games without making a bet, and wherein the amount of the wager determines the number of games of said one of said second game and said third game that said player can play.

2. The electronic gaming machine of claim 1, wherein said player must wager an amount to play one or more games of said second game when said first trigger event occurs.

3. The electronic gaming machine of claim 2, wherein said player must wager an amount to play each game of said one or more games of said second game.

4. The electronic gaming machine of claim 1, wherein one of said game enhancing elements is awarded during play of or forms part of said one or more of said second games, said game enhancing element also being applicable from the beginning of play of said third game.

5. The electronic gaming machine of claim 4, wherein said game enhancing element comprises one or more win multipliers.

6. The electronic gaming machine of claim 1, wherein said player must wager an amount to play one or more games of said third game when said second trigger event occurs.

7. The electronic gaming machine of claim 6, wherein said player must wager an amount to play each game of said one or more games of said third game.

8. The electronic gaming machine of claim 1, wherein the ratio of amount wagered to pay lines played for the wager is the same as the ratio of amount bet to pay lines played for said initial bet.

9. The electronic gaming machine of claim 1, wherein said second game comprises an enhanced version of said first game.

10. The electronic gaming machine of claim 1, wherein said third game comprises an enhanced version of said second game.

11. The electronic gaming machine of claim 1, wherein said third game comprises an enhanced version of said first game.

12. The electronic gaming machine of claim 1, wherein said first game, said second game and said third game are different to each other.

13. The electronic gaming machine of claim 1, wherein any game enhancing elements that are awarded during play of said second games are also applicable from the beginning of play of said third games.

14. The electronic gaming machine of claim 1, wherein said game enhancing elements comprise at least one or more of bonus prizes, collector symbols, a win multiplier, wild multipliers, bonus wilds, held columns, bonus reels, changed reel strips, changed pay conditions, changed pay combinations, changed pay values, additional or new arrays of reels, additional or new pay lines, random wild symbols, progressives, bonus credits, jackpot symbols, and one or more symbol replacements.

15. The electronic gaming machine of claim 1, wherein said electronic game controller causes display of said first game, said second game and/or said third game during play, said first game, said second game and said third game being inactive until triggered.

16. An electronic gaming machine comprising:

a display for displaying game symbols for playing a first game, wherein a player must make an initial bet to play said first game and wherein predetermined winning combinations of randomly selected game symbols in said first game results in the award of prizes to a player, vending slots for receiving monetary bets, an electronic game controller being adapted to determine if the initial bet has been made using the vending slots to initiate play of said first game and to control the display of game symbols on the display if the initial bet has been received, wherein, in response to a first trigger event during play of said first game, said electronic game controller causes said display to display game symbols for playing a second game, wherein predetermined winning combinations of randomly selected game symbols in said second game results in the award of prizes to said player and/or one or more game enhancing elements that are applied in said second game, and wherein, in response to a second trigger event during play of said second game, said electronic game controller causes said display to display game symbols for playing a third game, wherein predetermined winning combinations of randomly selected game symbols in said third game results in the award of prizes to said player and/or one or more game enhancing elements that are applied in said third game, wherein said player must wager an amount to play one or more games of one of said second and third games when said first trigger event or second trigger event occurs and said player can play the other of said second and third games without making a bet, and wherein said game symbols in said first game, said second game and said third game are arranged in differently shaped arrays.

17. The electronic gaming machine of claim 16, wherein said player must wager an amount to play one or more games of said second game when said first trigger event occurs.

18. The electronic gaming machine of claim 17, wherein said player must wager an amount to play each game of said one or more games of said second game.

19. The electronic gaming machine of claim 16, wherein one of said game enhancing elements is awarded during play of or forms part of said one or more of said second games, said game enhancing element also being applicable from the beginning of play of said third game.

20. The electronic gaming machine of claim 19, wherein said game enhancing element comprises one or more win multipliers.

21. The electronic gaming machine of claim 16, wherein said player must wager an amount to play one or more games of said third game when said second trigger event occurs.

22. The electronic gaming machine of claim 21, wherein said player must wager an amount to play each game of said one or more games of said third game.

23. The electronic gaming machine of claim 16, wherein the ratio of amount wagered to pay lines played for the wager is the same as the ratio of amount bet to pay lines played for said initial bet.

24. The electronic gaming machine of claim 16, wherein said second game comprises an enhanced version of said first game.

25. The electronic gaming machine of claim 16, wherein said third game comprises an enhanced version of said second game.

26. The electronic gaming machine of claim 16, wherein said third game comprises an enhanced version of said first game.

27. The electronic gaming machine of claim 16, wherein said first game, said second game and said third game are different to each other.

28. The electronic gaming machine of claim 16, wherein any game enhancing elements that are awarded during play of said second games are also applicable from the beginning of play of said third games.

29. The electronic gaming machine of claim 16, wherein said game enhancing elements comprise at least one or more of bonus prizes, collector symbols, a win multiplier, wild multipliers, bonus wilds, held columns, bonus reels, changed reel strips, changed pay conditions, changed pay combinations, changed pay values, additional or new arrays of reels, additional or new pay lines, random wild symbols, progressives, bonus credits, jackpot symbols, and one or more symbol replacements.

30. The electronic gaming machine of claim 16, wherein said electronic game controller causes display of said first game, said second game and/or said third game during play, said first game, said second game and said third game being inactive until triggered.

* * * * *